US006878679B2

(12) United States Patent
Sommerville-Roberts et al.

(10) Patent No.: US 6,878,679 B2
(45) Date of Patent: Apr. 12, 2005

(54) POUCHED COMPOSITIONS

(75) Inventors: Nigel Patrick Sommerville-Roberts, Newcastle Upon Tyne (GB); Bruno Matthieu Dasque, Newcastle Upon Tyne (GB); Thomas John Pounds, Cambridge (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/278,689

(22) Filed: Oct. 23, 2002

(65) Prior Publication Data

US 2003/0087783 A1 May 8, 2003

Related U.S. Application Data

(63) Continuation of application No. PCT/US01/07708, filed on Mar. 9, 2001.

(30) Foreign Application Priority Data

Apr. 28, 2000 (GB) ..... 0010249

(51) Int. Cl.[7] ..... C11D 17/04
(52) U.S. Cl. ..... 510/296; 510/406; 510/439
(58) Field of Search ..... 510/296, 406, 510/439

(56) References Cited

U.S. PATENT DOCUMENTS

| | | | | | |
|---|---|---|---|---|---|
| 4,082,678 | A | * | 4/1978 | Pracht et al. | 8/137 |
| 4,886,615 | A | * | 12/1989 | Dehan | 510/296 |
| 4,973,416 | A | | 11/1990 | Kennedy | 510/296 |
| 5,224,601 | A | | 7/1993 | Gouge et al. | 206/524.7 |
| 6,218,351 | B1 | * | 4/2001 | Busch et al. | 510/311 |
| 6,387,862 | B2 | * | 5/2002 | Busch et al. | 510/311 |
| 6,624,130 | B2 | * | 9/2003 | Giblin et al. | 510/297 |
| 6,727,215 | B2 | * | 4/2004 | Roberts et al. | 510/296 |
| 6,815,410 | B2 | * | 11/2004 | Boutique et al. | 510/295 |

FOREIGN PATENT DOCUMENTS

| | | | |
|---|---|---|---|
| EP | 0 132 726 | A2 | 2/1985 |
| EP | 0414462 | A2 * | 2/1991 |
| FR | 2 796 651 | | 1/2001 |
| GB | 2 000177 | A | 6/1978 |

* cited by examiner

*Primary Examiner*—Lorna M. Douyon
(74) *Attorney, Agent, or Firm*—Armina E. Matthews; Brahm J. Corstanje; Kim William Zerby

(57) ABSTRACT

A multi-compartment pouch made from a water-soluble film and having at least two compartments, where the multi-compartment pouch comprises a composition comprising a solid component and a liquid component, wherein one compartment comprises the solid component and another compartment comprises the liquid component.

15 Claims, No Drawings

POUCHED COMPOSITIONS

CROSS REFERENCE TO RELATED APPLICATIONS

This is a continuation of International Application PCT/US01/07708 with an international filing date of Mar. 9, 2001, published in English under PCT Article 21(2) which claims benefit of Great Britain Application No. 0010249.1, filed Apr. 28, 2000.

FIELD OF THE INVENTION

This invention relates to a pouch made from a water-soluble and having at least two compartments.

BACKGROUND TO THE INVENTION

Laundry detergent products can be found on the market to date in various forms, such as solid granular compositions and tablets, or liquid compositions. This gives the consumer a choice of detergent products they can use.

Some detergent ingredients currently used by the laundry industry, are preferably manufactured and processed in liquid form. These liquid ingredients are difficult or costly to include in a solid detergent composition. Also, certain ingredients are preferably transported and supplied to detergent manufacturers in a liquid form and require additional, and sometimes costly, process steps to enable them to be included in a solid detergent composition. An example of these detergent ingredients are surfactants, especially non-ionic surfactants which are typically liquid at room temperature or are typically transported and supplied to detergent manufacturers in liquid form.

Current methods of incorporating liquid ingredients into solid detergent compositions include absorbing the liquid ingredient onto a solid carrier, for example by mixing, agglomeration or spray-on techniques. Typically, solid detergent compositions comprise only low amounts of these liquid detergent ingredients due to the difficulty and expense of incorporating these liquid ingredients into a solid detergent.

However, it is desirable to include higher levels of liquid ingredients such as certain surfactant or solutions thereof in a detergent composition with a substantial amount of solid detergent ingredients. It is also desirable to be able to incorporate detergent ingredients that are typically transported and supplied in liquid form in a detergent composition comprising a substantial amount of solid detergent ingredients without the need for extra costly and difficult processing steps.

The inventors have found that by using a multi-compartment water-soluble pouch comprising at least two compartments, liquid detergent ingredients such as surfactants can be included in a detergent composition comprising other solid detergent ingredients, without the need for difficult, costly manufacturing and processing steps to incorporate said liquid ingredient as a solid in the solid detergent. The liquid detergent ingredients are comprised by one compartment of a multi-compartment pouch whilst the solid detergent ingredients are comprised by a second compartment.

SUMMARY OF THE INVENTION

A multi-compartment water-soluble pouch made from a water-soluble film and having at least two compartments is provide, which comprises a composition comprising a solid component and a liquid component, wherein;

(a) a first compartment comprises a liquid component comprising (by weight of the liquid component) at least 50% surfactant; and (b) a second compartment comprises a solid component.

DETAILED DESCRIPTION OF THE INVENTION

Multi-compartment Pouch and Materials Thereof

The multi-compartment pouch of the invention, herein referred to as "pouch", comprises at least two compartments. The pouch herein is typically a closed structure, made of materials described herein, enclosing a volume space which is separated into at least two, preferably two compartments. The pouch comprises a composition comprising a solid component and a liquid component. The pouch can be of any form, shape and material which is suitable to hold the composition, e.g. without allowing the release of the composition from the pouch prior to contact of the pouch to water. The exact execution will depend on for example the type and amount of the composition in the pouch, the number of compartments in the pouch, the characteristics required from the pouch to hold, protect and deliver or release the compositions.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouch is made from a water-soluble film which encloses an inner volume, said inner volume is divided into the compartments of the pouch.

The compartments of the pouch herein are closed structures, made from a water-soluble film which enclose a volume space which comprises the solid component or the liquid component of the composition. Said volume space is preferably enclosed by a water-soluble film in such a manner that the volume space is separated from the outside environment.

The solid or liquid component that are comprised by the compartment of the pouch are contained in the volume space of the compartment, and are separated from the outside environment by a barrier of water-soluble film.

The term "separated" means for the purpose of this invention "physically distinct, in that a first ingredient comprised by a compartment is prevented from contacting a second ingredient if said second ingredient is not comprised by the same compartment which comprises said first ingredient".

The term "outside environment" means for the purpose of this invention "anything which cannot pass through the water-soluble film which encloses the compartment and which is not comprised by the compartment".

The compartment is suitable to hold the solid or liquid component, e.g. without allowing the release of the components from the compartment prior to contact of the pouch to water. The compartment can have any form or shape, depending on the nature of the material of the compartment, the nature of the components or composition, the intended use, amount of the components etc.

It may be preferred that the compartment which comprises the liquid component also comprises an air bubble, preferably the air bubble has a volume of no more than 50%, preferably no more than 40%, more preferably no more than 30%, more preferably no more than 20%, more preferably no more than 10% of the volume space of said compartment. Without being bound by theory, it is believed that the presence of the air bubble increases the tolerance of the pouch to the movement of liquid component within the compartment, thus reducing the risk of the liquid component leaking from the compartment.

The pouch is made from a water-soluble film, said water-soluble film typically has a solubility of at least 50%, preferably at least 75% or even at least 95%, as measured by the method set out hereinafter using a glass-filter with a maximum pore size of 50 microns, namely:

Gravimetric method for determining water-solubility of the material of the compartment and/or pouch:

10 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility or dispersability can be calculated.

Preferred films are polymeric materials, preferably polymers which are formed into a film or sheet. The film can for example be obtained by casting, blow-moulding, extrusion or blow extrusion of the polymer material, as known in the art. Preferred polymers, copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). Preferably, the level of polymer in the film, for example a PVA polymer, is at least 60%.

The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartments or pouch, depending on the application thereof and the required needs. For example, it may be preferred that a mixture of polymers is present in the film, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-soluble.

It may be preferred that the polymer present in the film is from 60% to 98% hydrolysed, preferably 80% to 90%, to improve the dissolution of the material.

Most preferred are films which comprise a PVA polymer with similar properties to the film which comprises a PVA polymer and is known under the trade reference M8630, as sold by Chris-Craft Industrial Products of Gary, Ind., US.

The film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the pouched composition is a detergent composition, that the pouch or compartment material itself comprises a detergent additive to be delivered to the wash water, for example organic polymeric soil release agents, dispersants, dye transfer inhibitors.

The compartments and preferably pouch as a whole are made from water-soluble film. Suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations of these.

Composition

The pouch comprises a composition, typically said composition is contained in the volume space of the pouch.

Preferred compositions are cleaning compositions or fabric care compositions, preferably hard surface cleaners, more preferably laundry or dish washing compositions, including detergents, pre-treatment or soaking compositions, and other rinse additive compositions.

Typically, the composition comprises such an amount of a cleaning composition, that one or a multitude of the pouched compositions is or are sufficient for one wash.

Preferably, the composition comprises at least one surfactant and at least one building agent.

The composition comprises a solid component and a liquid component. A first compartment comprises the solid component and a second compartment comprises the liquid component, so that the solid component and liquid component are separated by a water-soluble film.

Liquid Component

The liquid component is comprised by a compartment of the pouch. Said compartment is a different compartment to the compartment that comprises the solid component.

The liquid component of the invention comprises (by weight of the liquid component) at least 50%, preferably at least 55%, more preferably at least 60%, more preferably at least 70%, more preferably at least 80% surfactant. Typically the surfactant is a liquid at room temperature. Preferably, the surfactant is a nonionic surfactant, an anionic surfactant or a combination thereof, most preferably the surfactant is a nonionic surfactant.

Preferably, said liquid component of the invention comprises a solvent or a perfume. Preferably, said liquid component comprises (by weight of the liquid component) at least 2%, more preferably at least 5%, more preferably at least 10%, more preferably at least 40% perfume. Preferably, said liquid component comprises (by weight of liquid component) from 0. 1% to 30%, more preferably from 5% to 25%, more preferably from 10% to 20% solvent. Preferably said solvent is an alcohol based solvent, more preferably said solvent is ethanol and/or n-butoxy propoxy propanol.

Preferably, the liquid component is substantially liquid in that at least 90%, more preferably at least 95%, more preferably at least 98% ingredients comprised by the liquid component are in a liquid form at room temperature.

Solid Component

The solid component is comprised by a compartment of the pouch. Said compartment is a different compartment to the compartment that comprises the liquid component.

Said solid component preferably comprises (by weight of the solid component) at least 10%, more preferably at least 20%, more preferably at least 30% water-insoluble solid material.

Preferably, said water-insoluble solid material includes water-insoluble building agents, preferably the water-insoluble building agent is an aluminosilicate, or water-insoluble fabric softening agent such as clay. Preferably, said water-insoluble solid material comprises a water-insoluble building agent. Preferred water-insoluble building agents are described in more detail hereinafter.

Said solid composition preferably comprises at least one detergent ingredient selected from the group consisting of building agent, chelating agent, bleaching agent, bleach activator, enzyme, brightener, suds suppressor and dye. Preferably, said detergent ingredient is in the form of a solid.

It may even be possible that part or all of the ingredients of the solid component are not pre-granulated, such as agglomerated, spray-dried, extruded, prior to incorporation into the compartment, and that the component is a mixture of dry-mixed powder ingredients or even raw materials. Preferred may be that for example less than 60% or even less than 40% or even less than 20% of the component is a free-flowable pre-granulated granules.

Preferably the solid component is substantially solid in that at least 90%, preferably at least 95%, more preferably at least 98% of the ingredients comprised by the solid component are in a solid form. Preferably the solid component comprises ingredients that are either difficult or costly to include in a substantially liquid composition or that are typically transported and supplied as solid ingredients which require additional processing steps to enable them to be included in a substantially liquid composition.

Detersive Surfactants

Preferably, surfactants herein are in liquid form and are comprised by the liquid component of the composition. More preferably, the nonionic surfactants herein, anionic surfactants herein or a combination thereof, are in liquid form and are comprised by the liquid component of the composition. Even more preferably, the nonionic surfactants herein are in liquid form and are comprised by the liquid component of the composition.

Nonionic Alkoxylated Surfactant

Essentially any alkoxylated nonionic surfactants can be comprised by the composition herein. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Highly preferred are nonionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Nonionic Polyhydroxy Fatty Acid Amide Surfactant

Polyhydroxy fatty acid amides are highly preferred nonionic surfactant comprised by the composition herein, in particular those having the structural formula $R^2CONR^1Z$ wherein: R1 is H, $C_{1-18}$, preferably $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ or $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

A highly preferred nonionic polyhydroxy fatty acid amide surfactant for use herein is a $C_{12}$–$C_{14}$, a $C_{15}$–$C_{17}$ and/or $C_{16}$–$C_{18}$ alkyl N-methyl glucamide.

It may be particularly preferred that the composition herein comprises a mixture of a $C_{12}$–$C_{18}$ alkyl N-methyl glucamide and condensation products of an alcohol having an alkyl group containing from 8 to 20 carbon atoms with from 2 to 9 moles and in particular 3 or 5 moles, of ethylene oxide per mole of alcohol.

The polyhydroxy fatty acid amide can be prepared by any suitable process. One particularly preferred process is described in detail in WO 9206984. A product comprising about 95% by weight polyhydroxy fatty acid amide, low levels of undesired impurities such as fatty acid esters and cyclic amides, and which is molten typically above about 80° C., can be made by this process.

Nonionic Fatty Acid Amide Surfactant

Fatty acid amide surfactants or alkoxylated fatty acid amides can also be comprised by the composition herein. They include those having the formula: $R^6CON(R^7)(R^8)$ wherein $R^6$ is an alkyl group containing from 7 to 21, preferably from 9 to 17 carbon or even 11 to 13 carbon atoms and $R^7$ and $R^8$ are each individually selected from the group consisting of hydrogen, $C_1$–$C_4$ alkyl, $C_1$–$C_4$ hydroxyalkyl, and $—(C_2H_4O)_xH$, where x is in the range of from 1 to 11, preferably 1 to 7, more preferably form 1–5, whereby it may be preferred that $R^7$ is different to $R^8$, one having x being 1 or 2, one having x being from 3 to 11 or preferably 5.

Nonionic Alkyl Esters of Fatty Acid Surfactant

Alkyl esters of fatty acids can also be comprised by the composition herein. They include those having the formula: $R^9COO(R^{10})$ wherein $R^9$ is an alkyl group containing from 7 to 21, preferably from 9 to 17 carbon or even 11 to 13 carbon atoms and $R^{10}$ is a $C_1$–$C_4$ alkyl, $C_1$–$C_4$ hydroxyalkyl, or $—(C_2H_4O)_xH$, where x is in the range of from 1 to 11, preferably 1 to 7, more preferably form 1–5, whereby it may be preferred that $R^{10}$ is a methyl or ethyl group.

Nonionic Alkylpolysaccharide Surfactant

Alkylpolysaccharides can also be comprised by the composition herein, such as those disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(glycosyl)_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Polyethylene/propylene Glycols

The composition herein may comprise polyethylene and/or propylene glycol, particularly those of molecular weight 1000–10000, more particularly 2000 to 8000 and most preferably about 4000.

Anionic Surfactant

The composition herein, preferably comprises one or more anionic surfactants. Any anionic surfactant useful for detersive purposes is suitable. Examples include salts (including, for example, sodium, potassium, ammonium, and substituted ammonium salts such as mono-, di- and triethanol amine salts) of the anionic sulphate, sulphonate, carboxylate and sarcosinate surfactants. Anionic sulphate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulphate Surfactant

Anionic sulphate surfactants suitable for use herein include the linear and branched primary and secondary alkyl sulphates, alkyl ethoxysulphates, fatty oleoyl glycerol sulphates, alkyl phenol ethylene oxide ether sulphates, the $C_5$–$C_{17}$ acyl-N-($C_1$–$C_4$ alkyl) and -N-($C_1$–$C_2$ hydroxyalkyl) glucamine sulphates, and sulphates of alkylpolysaccharides such as the sulphates of alkylpolyglucoside (the nonionic non-sulphated compounds being described herein).

Alkyl sulphate surfactants are preferably selected from the linear and branched primary $C_9$–$C_{22}$ alkyl sulphates, more preferably the $C_{11}$–$C_{15}$ is branched chain alkyl sulphates and the $C_{12}$–$C_{14}$ linear chain alkyl sulphates.

Alkyl ethoxysulfate surfactants are preferably selected from the group consisting of the $C_{10}$–$C_{18}$ alkyl sulphates which have been ethoxylated with from 0.5 to 50 moles of ethylene oxide per molecule. More preferably, the alkyl ethoxysulfate surfactant is a $C_{11}$–$C_{18}$, most preferably $C_{11}$–$C_{15}$ alkyl sulphate which has been ethoxylated with from 0.5 to 7, preferably from 1 to 5, moles of ethylene oxide per molecule.

Anionic Sulphonate Surfactant

Anionic sulphonate surfactants suitable for use herein include the salts of $C_5$–$C_{20}$ linear or branched alkylbenzene sulphonates, alkyl ester sulphonates, in particular methyl ester sulphonates, $C_6$–$C_{22}$ primary or secondary alkane sulphonates, $C_6$–$C_{24}$ olefin sulphonates, sulphonated polycarboxylic acids, alkyl glycerol sulphonates, fatty acyl glycerol sulphonates, fatty oleyl glycerol sulphonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from O to 10, and the ethoxylate distribution is such that, on a weight basis, the amount of material where x is 0 is less than 20%, and M is a cation. Suitable alkyl polyethoxy polycarboxylate surfactants include those having the formula $RO—(CHR_1—CHR_2—O)_X—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressers.

Alkali Metal Sarcosinate Surfactant

Other suitable anionic surfactants are the alkali metal sarcosinates of formula $R—CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Cationic Surfactant

Another preferred surfactant is a cationic surfactant, which may preferably be present at a level of from 0.1% to 60% by weight of the composition herein, more preferably from 0.4% to 20%, most preferably from 0.5% to 5% by weight of the composition herein.

When present, the ratio of the anionic surfactant to the cationic surfactant is preferably from 35:1 to 1:3, more preferably from 15:1 to 1:1, most preferably from 10:1 to 1:1.

Preferably the cationic surfactant is selected from the group consisting of cationic ester surfactants, cationic mono-alkoxylated amine surfactants, cationic bis-alkoxylated amine surfactants and mixtures thereof.

Cationic Mono-alkoxylated Amine Surfactants

Preferred cationic mono-alkoxylated amine surfactant for use herein, has the general formula:

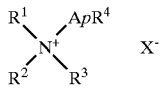

wherein $R^1$ is an alkyl or alkenyl moiety containing from about 6 to about 18 carbon atoms, preferably 6 to about 16 carbon atoms, most preferably from about 6 to about 11 carbon atoms; $R^2$ and $R^3$ are each independently alkyl groups containing from one to about three carbon atoms, preferably methyl; $R^4$ is selected from hydrogen (preferred), methyl and ethyl, $X^-$ is an anion such as chloride, bromide, methylsulphate, sulphate, or the like, to provide electrical neutrality; A is selected from $C_1$–$C_4$ alkoxy, especially ethoxy (i.e., $—CH_2CH_2O—$), propoxy, butoxy and mixtures thereof; and p is from 1 to about 30, preferably 1 to about 15, most preferably 1 to about 8.

Highly preferred cationic mono-alkoxylated amine surfactants for use herein are of the formula:

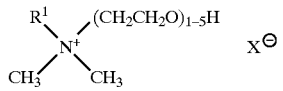

wherein $R^1$ is $C_6$–$C_{18}$ hydrocarbyl and mixtures thereof, preferably $C_6$–$C_{14}$, especially $C_6$–$C_{11}$ alkyl, preferably $C_8$ and $C_{10}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

Cationic Bis-alkoxylated Amine Surfactant

The cationic bis-alkoxylated amine surfactant for use herein, has the general formula:

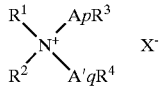

wherein $R^1$ is an alkyl or alkenyl moiety containing from about 6 to about 18 carbon atoms, preferably 6 to about 16 carbon atoms, more preferably 6 to about 11, most preferably from about 8 to about 10 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulphate, sulphate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula:

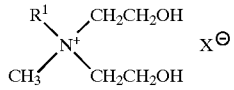

wherein $R^1$ is $C_6$–$C_{18}$ hydrocarbyl and mixtures thereof, preferably $C_6$, $C_8$, $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

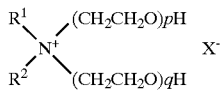

wherein $R^1$ is $C_6$–$C_{18}$ hydrocarbyl, preferably $C_6$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol™ C2M Conc. manufactured by Miranol, Inc., Dayton, N.J.

Zwitterionic Surfactant

Zwitterionic surfactants can also be comprised by the composition herein. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Preferred Ingredients of the Liquid and Solid Components

The composition comprises a liquid component and a solid component. Said liquid component is substantially liquid in that the liquid component comprises less than 10%, preferably less than 5%, more preferably less than 2% material in solid form at room temperature. Said solid component is substantially solid in that the solid component comprises less than 10%, preferably less than 5%, more preferably less than 2% material in liquid form at room temperature. Thus, ingredients that are difficult or costly to include in a composition comprising a substantial amount of solid ingredients are comprised by the liquid component. The preferred amounts of ingredients described herein are % by weight of the whole composition and not % by weight of either the solid component or liquid component which comprise said ingredient.

Water Insoluble Building Agent

The composition herein preferably comprises a water-insoluble building agent. Preferably, the solid component of the composition herein comprises a water-insoluble builder.

Examples of water insoluble builders include the sodium aluminosilicates.

Suitable aluminosilicate zeolites have the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276H_2O$.

Preferred crystalline layered silicates for use herein have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. Herein, x in the general formula above preferably has a value of 2, 3 or 4 and is preferably 2. The most preferred material is $\delta$-$Na_2Si_2O_5$, available from Hoechst AG as NaSKS-6.

Chelating Agents

The composition herein, preferably comprises a chelating agent. By chelating agent it is meant herein components which act to sequester (chelate) heavy metal ions. These components may also have calcium and magnesium chelation capacity, but preferentially they show selectivity to binding heavy metal ions such as iron, manganese and copper.

Chelating agents are generally present at a level of from 0.05% to 2%, preferably from 0.1% to 1.5%, more preferably from 0.25% to 1.2% and most preferably from 0.5% to 1% by weight of the composition herein.

Suitable chelating agents for use herein include organic phosphonates, such as the amino alkylene poly (alkylene phosphonates), alkali metal ethane 1-hydroxy bisphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable chelating agents for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Other suitable chelating agents for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Water-soluble Building Agent

The composition herein may comprises a water-soluble building agent, typically present at a level of from 0% to 36% by weight, preferably from 1% to 35% by weight, more preferably from 10% to 35%, even more preferably from 12% to 30% by weight of the composition or particle. Preferably, the water-soluble builder compound is an alkali or earth alkali metal salt of phosphate present at the level described above.

Other typical water-soluble building agents include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulphonated pyrolysed citrates described in British Patent No. 1,439,000. Preferred polycarboxylates are hydroxycarboxylates containing up to three carboxy groups per molecule, more particularly citrates.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from about 6 to 21, and salts of phytic acid.

Peroxide Source

Another preferred ingredient is a perhydrate bleach, such as salts of percarbonates, particularly the sodium salts, and/or organic peroxyacid bleach precursor. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance.

Inorganic perhydrate salts are a preferred source of peroxide. Preferably these salts are present at a level of from 0.01% to 50% by weight, more preferably of from 0.5% to 30% by weight of the composition or component.

Examples of inorganic perhydrate salts include percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilise a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the compositions herein.

Bleach Activator

The composition herein preferably comprises a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide.

The bleach activator may alternatively, or in addition comprise a preformed peroxy acid bleach.

Preferably, at least one of the bleach activators, preferably a peroxy acid bleach precursor having an average particle size, by weight, of from 600 microns to 1400 microns, preferably from 700 microns to 1100 microns is present in the composition herein.

Hereby, it may be preferred that at least 80%, preferably at least 90% or even at least 95% or even substantially 100% of the component or components comprising the bleach activator have a particle size of from 300 microns to 1700 microns, preferably from 425 microns to 1400 microns.

The hydrophobic peroxy acid bleach precursor preferably comprises a compound having a oxy-benzene sulphonate group, preferably NOBS, DOBS, LOBS and/or NACA-OBS, as described herein.

The hydrophilic peroxy acid bleach precursor preferably comprises TAED, as described herein.

Organic Peroxyacid Bleaching System

The composition herein preferably comprises an organic peroxyacid precursor. The production of the organic peroxyacid may occur by an in situ reaction of such a precursor with the percarbonate source. In an alternative preferred execution a pre-formed organic peroxyacid is incorporated directly into the composition.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as:

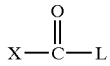

where L is a leaving group and X is essentially any functionality, such that on perhydrolysis the structure of the peroxyacid produced is:

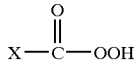

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use herein.

Preferred L groups are selected from the group consisting of:

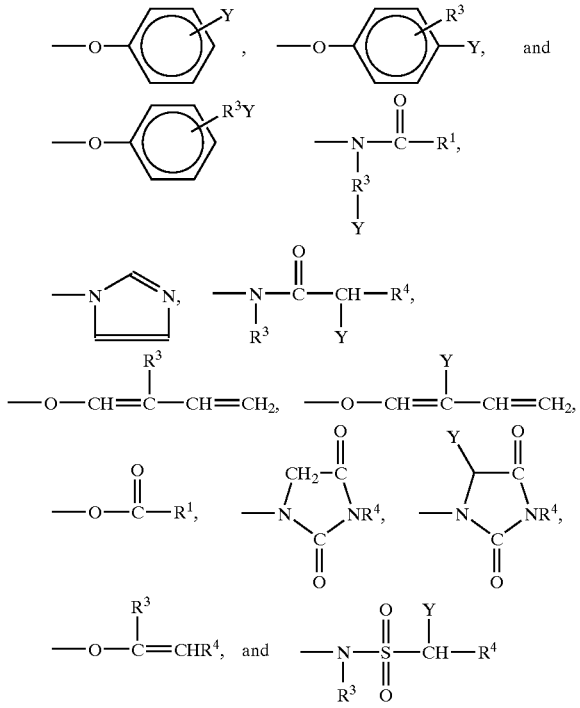

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably —$SO_3^-M^+$ and —$CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulphate or acetate anion.

Amide Substituted Alkyl Peroxyacid Precursors

Amide substituted alkyl peroxyacid precursor compounds are suitable herein, including those of the following general formulae:

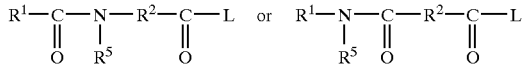

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Pre-formed Organic Peroxyacid

The organic peroxyacid bleaching system may contain a pre-formed organic peroxyacid.

A preferred class of organic peroxyacid compounds are the amide substituted compounds of the following general formulae:

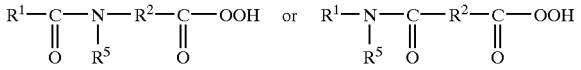

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Enzyme

Another preferred optional ingredient useful in the composition herein, is one or more additional enzymes.

Preferred additional enzymatic materials include the commercially available lipases, cutinases, amylases, neutral and alkaline proteases, esterases, cellulases, pectinases, lactases and peroxidases conventionally incorporated into compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the composition herein at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocade, and those sold under the tradename Termamyl and BAN by Novo Industries A/S. Amylase enzyme may be incorporated into the composition herein at a level of from 0.0001% to 2% active enzyme by weight of the composition.

Lipolytic enzyme may be present at levels of active lipolytic enzyme of from 0.0001% to 10% by weight of the particle, preferably 0.001% to 3% by weight of the composition, most preferably from 0.001% to 0.5% by weight of the compositions.

The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Suds Suppressing System

The composition may comprise a suds suppresser at a level less than 10%, preferably 0.001% to 10%, preferably from 0.01% to 8%, most preferably from 0.05% to 5%, by weight of the composition Preferably the suds suppresser is either a soap, paraffin, wax, or any combination thereof. If the suds suppresser is a suds suppressing silicone, then the detergent composition preferably comprises from 0.005% to 0.5% by weight a suds suppressing silicone.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of the composition herein, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units. Preferably the composition herein comprises from 0.005% to 0.5% by weight suds suppressing silicone.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppresser typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination:
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the antifoam compound;

wherein said silica/silicone antifoam compound is incorporated at a level of less than 5%, preferably 0.01% to 5%, more preferably 0.05% to 4%, even more preferably 0.1% to 3%, by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of less than 5%, preferably 0.01% to 5%, more preferably 0.05% to 4%, even more preferably 0.1% to 3%, by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of less than 5%, preferably 0.01% to 5%, more preferably 0.05% to 4%, even more preferably 0.1% to 3%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Polymeric Dye Transfer Inhibiting Agents

The composition herein may also comprise from 0.01% to 10%, preferably from 0.05% to 0.5% by weight of polymeric dye transfer inhibiting agents. These polymeric compounds are in addition to the polymeric compound of the water-soluble film.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

a) Polyamine N-oxide Polymers

Polyamine N-oxide polymers suitable for use herein contain units having the following structure formula:

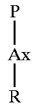

(I)

wherein P is a polymerisable unit, and

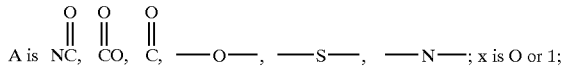

A is NC, CO, C, —O—, —S—, —N—; x is O or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures

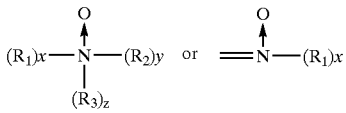

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups. The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Other suitable polyamine N-oxides are the polyamine oxides whereto the N—O group is attached to the polymerisable unit. A preferred class of these polyamine N-oxides comprises the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof.

The polyamine N-oxides can be obtained in almost any degree of polymerisation. The degree of polymerisation is not critical provided the material has the desired water-solubility and dye-suspending power. Typically, the average molecular weight is within the range of 500 to 1000,000.

b) Copolymers of N-vinylpyrrolidone and N-vinylimidazole

Suitable herein are co-polymers of N-vinylimidazole and N-vinylpyrrolidone having an average molecular weight range of from 5,000 to 50,000. The preferred copolymers have a molar ratio of N-vinylimidazole to N-vinylpyrrolidone from 1 to 0.2.

c) Polyvinylpyrrolidone

The composition herein may also utilise polyvinylpyrrolidone ("PVP") having an average molecular weight of from 2,500 to 400,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Co-operation include Sokalan HP 165 and Sokalan HP 12.

d) Polyvinyloxazolidone

The composition herein may also utilise polyvinyloxazolidones as polymeric dye transfer inhibiting agents. Said polyvinyloxazolidones have an average molecular weight of from 2,500 to 400,000.

e) Polyvinylimidazole

The composition herein may also utilise polyvinylimidazole as polymeric dye transfer inhibiting agent. Said polyvinylimidazoles preferably have an average molecular weight of from 2,500 to 400,000.

Optical Brightener

The composition herein may also optionally comprise from 0.005% to 5% by weight of certain types of hydrophilic optical brighteners.

Hydrophilic optical brighteners useful herein include those having the structural formula:

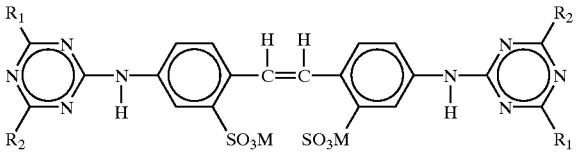

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Cationic Fabric Softening Agents

Cationic fabric softening agents are preferably present in the composition herein. Suitable cationic fabric softening agents include the water insoluble tertiary amines or dilong chain amide materials as disclosed in GB-A-1 514 276 and EP-B-0 011 340. Preferably, these water-insoluble tertiary amines or dilong chain amide materials are comprised by the solid component of the composition herein.

Cationic fabric softening agents are typically incorporated at total levels of from 0.5% to 15% by weight, normally from 1% to 5% by weight.

Other Optional Ingredients

Other optional ingredients suitable for inclusion in the composition herein include perfumes, colours and filler salts, with sodium sulphate being a preferred filler salt.

Laundry Washing Method

Preferably, the multi-compartment pouch dissolves or disintegrates in water to deliver the solid detergent ingredients and liquid detergent ingredients to the washing cycle. Typically, the multi-compartment pouch is added to the dispensing draw, or alternatively to the drum, of an automatic washing machine.

Preferably, the multi-compartment pouch comprises all of the detergent ingredients of the detergent composition used in the washing. Although it may be preferred that some detergent ingredients are not comprised by the multi-compartment pouch and are added to the washing cycle separately. In addition, one or more detergent compositions other than the detergent composition comprised by the multi-compartment pouch can be used during the laundering process, such that said detergent composition comprised by the multi-compartment pouch is used as a pre-treatment, main-treatment, post-treatment or a combination thereof during such a laundering process.

EXAMPLES

Example I

A piece of plastic is placed in a mould to act as a false bottom. The mould consists of a cylindrical shape and has a diameter of 45 mm and a depth of 25 mm. A 1 mm thick layer of rubber is present around the edges of the mould. The mould has some holes in the mould material to allow a vacuum to be applied. With the false bottom in place the depth of the mould is 12 mm. A piece of Chris-Craft M-8630 film is placed on top of this mould and fixed in place. A vacuum is applied to pull the film into the mould and pull the film flush with the inner surface of the mould and the false bottom. 5 ml of the liquid component of a detergent composition is poured into the mould. Next, a second piece of Chris-Craft M-8630 film is placed over the top of the mould with the liquid component and sealed to the first piece of film by applying an annular piece of flat metal of an inner diameter of 46 mm and heating that metal under moderate pressure onto the ring of rubber at the edge of the mould to heat-seal the two pieces of film together to form a compartment comprising the liquid component. The metal ring is typically heated to a temperature of from 135° C. to 150° C. and applied for up to 5 seconds.

The compartment comprising the liquid compartment is removed from the mould and the piece of plastic acting as a false bottom is also removed from the mould. A third piece of Chris-Craft M-8630 film is placed on top of the mould and fixed in place. A vacuum is applied to pull the film into the mould and pull the film flush with the inner surface of the mould. 40 g of the solid component of the detergent composition is poured into the mould. Next, the compartment comprising the liquid component is placed over the top of the mould with the solid component and is sealed to the third layer of film by applying an annular piece of flat metal of an inner diameter of 46 mm and heating that metal under moderate pressure onto the ring of rubber at the edge of the mould to heat-seal the pieces of film together to form a pouch comprising two compartments, where a first compartment comprises the liquid component of the detergent composition and a second compartment comprises the solid component of the detergent composition. The metal ring is typically heated to a temperature of from 135° C. to 150° C. and applied for up to 5 seconds.

Example II

A pouch was made by the process described in example I which comprises the following liquid component and solid component.

| Liquid component detergent ingredient | Amount (by weight of the liquid component) |
|---|---|
| Nonionic surfactant | 74% |
| Solvent | 12% |
| Perfume | 7% |
| Water | 2% |
| Minors | to 100% |

| Solid component detergent ingredient | Amount (by weight of the solid component) |
|---|---|
| Bleaching agent | 26% |
| Chelating agent | 0.8% |
| Enzyme | 6% |
| Carbonate | 12% |
| Suds suppressor | 1% |
| Sodium carbonate | 6% |
| Brightener | 0.5% |
| Zeolite | 40% |
| Minors | to 100% |

Example III

A pouch was made by the process described in example I which comprises the following liquid component and solid component.

| Liquid component detergent ingredient | Amount (by weight of liquid component) |
|---|---|
| Nonionic surfactant | 69% |
| Solvent | 9% |
| Perfume | 10% |
| Water | 3% |
| Minors | to 100% |

| Solid component detergent ingredient | Amount (by weight of the solid component) |
|---|---|
| Carbonate | 6% |
| Chelating agent | 12% |
| Enzyme | 30% |
| Suds suppressor | 1% |
| Sodium carbonate | 6% |
| Brightener | 3% |
| Zeolite | 40% |
| Minors | to 100% |

Example IV

A pouch was made by the process described in example I which comprises the following liquid component and solid component.

| Liquid component detergent ingredient | Amount (by weight of liquid component) |
|---|---|
| Nonionic surfactant | 69% |
| Solvent | 9% |
| Perfume | 10% |
| Water | 3% |
| Minors | to 100% |

| Solid component detergent ingredient | Amount (by weight of the solid component) |
|---|---|
| Anionic surfactant | 15% |
| Cationic surfactant | 1.5% |
| Bleaching agent | 36% |
| Chelating agent | 2% |
| Enzyme | 10% |
| Suds suppressor | 1% |
| Sodium carbonate | 6% |
| Brightener | 3% |
| Zeolite | 23.5% |
| Minors | to 100% |

Example V

A pouch was made by the process described in example I which comprises the following liquid component and solid component.

| Liquid component detergent ingredient | Amount (by weight of liquid component) |
|---|---|
| Nonionic surfactant (neodol 23-5) | 57% |
| Anionic surfactant (HLAS) | 20% |
| Mono-ethanol amine | 8% |
| Solvent (propanediol) | 9% |
| Perfume | 10% |
| Water | 3% |
| Minors | to 100% |

| Solid component detergent ingredient | Amount (by weight of the solid component) |
|---|---|
| Anionic surfactant | 20% |
| Cationic surfactant | 1.5% |
| Bleaching agent | 36% |
| Chelating agent | 2% |
| Enzyme | 10% |
| Suds suppressor | 1% |
| Sodium carbonate | 6% |
| Brightener | 3% |
| Zeolite | 20% |
| Minors | to 100% |

Example VI

A pouch was made by the process described in example I which comprises the following liquid component and solid component.

| Liquid component detergent ingredient | Amount (by weight of liquid component) |
|---|---|
| Nonionic surfactant (neodol 23-5) | 55% |
| Anionic surfactant[1] | 20% |
| Mono-ethanol amine | 8% |
| Soil dispersant[2] | 2% |
| Solvent (propanediol) | 9% |
| Perfume | 10% |
| Water | 3% |
| Minors | to 100% |

[1]Linear $C_{11}$–$C_{13}$ alkyl benzene sulfonic acid
[2]$(bis((C_2H_5O)(C_2H_4O)_n)(CH_3)—N^+—C_xH_{2x}—N^+—(CH_3)\text{-}bis((C_2H_5O)(C_2H_4O)_n)$, wherein n = from 15 to 30, and x = from 3 to 8.

| Solid component detergent ingredient | Amount (by weight of the solid component) |
|---|---|
| Anionic surfactant | 20% |
| Bleaching agent | 36% |
| Chelating agent | 2% |
| Enzyme | 10% |
| Suds suppressor | 1% |
| Sodium carbonate | 6% |
| Brightener | 3% |
| Zeolite | 20% |
| Minors | to 100% |

What is claimed is:

1. A multi-compartment pouch made from a water-soluble film and having at least two compartments, wherein said multi-compartment pouch comprises a composition comprising a solid component and a liquid component, wherein;

(a) a first compartment comprises the liquid component, wherein said liquid component comprises at least 70%, by weight of the liquid component, surfactant and 2% to 3%, by weight of the liquid component, water; and (b) a second compartment comprises a solid component.

2. A multi-compartment pouch according to claim 1, wherein said water-soluble film comprises a polyvinyl alcohol polymer.

3. A multi-compartment pouch according to claim 1, wherein said liquid component comprises a solvent.

4. A multi-compartment pouch according to claim 1, wherein said surfactant is selected from the group consisting of nonionic surfactants, anionic surfactants, and mixture thereof.

5. A multi-compartment pouch according to claim 1, wherein said solid component comprises an ingredient selected form the group consisting of building agent, chelating agent, bleaching agent, bleach activator, enzyme, brightener, suds suppressor and dye.

6. A multi-compartment pouch according to claim 1, wherein said surfactant is a nonionic surfactant.

7. A multi-compartment pouch according to claim 5, wherein the solid component comprises an enzyme and the surfactant is an anionic surfactant.

8. A multi-compartment pouch according to claim 5, wherein the first compartment comprises an air bubble having a volume of no more than 50% of the volume space of the compartment.

9. A multi-compartment pouch according to claim 1, wherein the solid component comprises at least 20%, by weight, of a water-insoluble solid material.

10. A multi-compartment pouch according to claim 1, wherein the solid component comprises a bleach activator.

11. A multi-compartment pouch made from a water-soluble film and having at least two compartments, wherein said multi-compartment pouch comprises a composition comprising a solid component and a liquid component, wherein;

(a) a first compartment comprises the liquid component, wherein said liquid component comprises at least 70% by weight of the liquid component, of a surfactant selected from the group consisting of anionic surfactants, nonionic surfactants, and mixtures thereof, and 2% to 3%, by weight of the liquid component, water and (b) a second compartment comprises the solid component, wherein said solid component comprises an enzyme.

12. A multi-compartment pouch according to claim 11, wherein the first compartment comprises an air bubble having a volume of no more than 50% of the volume space of the compartment.

13. A multi-compartment pouch according to claim 11 wherein the film has a solubility of at least 50%.

14. A multi-compartment pouch according to claim 11 wherein the water soluble film is a polymeric material selected from the group consisting of polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers, hydroxypropyl methyl cellulose, and mixtures thereof.

15. A multi-compartment pouch according to claim 11, wherein said solid component further comprises an ingredient selected from the group consisting of building agent, chelating agent, bleaching agent, bleach activator, brightener, suds suppressor and dye.

* * * * *